US006174659B1

(12) United States Patent
Schell et al.

(10) Patent No.: US 6,174,659 B1
(45) Date of Patent: Jan. 16, 2001

(54) METHOD FOR FORMING A BASE FOR AN IMAGING ELEMENT, AND AN IMAGING ELEMENT COMPRISING SUCH BASE, WITH IMPROVED CROSSLINKING AGENT

(75) Inventors: Brian A. Schell, Honeoye Falls; Charles C. Anderson, Penfield, both of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/391,872

(22) Filed: Sep. 8, 1999

Related U.S. Application Data

(60) Provisional application No. 60/099,533, filed on Sep. 9, 1998.

(51) Int. Cl.[7] ..... G03C 1/795
(52) U.S. Cl. ..... 430/531
(58) Field of Search ..... 430/531

(56) References Cited

U.S. PATENT DOCUMENTS

| | | | |
|---|---|---|---|
| 4,123,278 | 10/1978 | Van Paesschen et al. | 430/535 |
| 4,824,756 | 4/1989 | Nakamura | 430/138 |
| 4,963,461 | 10/1990 | Takahashi et al. | 430/138 |
| 5,096,975 | 3/1992 | Anderson et al. | 525/328.5 |
| 5,198,499 | 3/1993 | Anderson et al. | 525/201 |
| 5,318,878 | 6/1994 | Jones et al. | 430/271 |
| 5,576,163 | 11/1996 | Anderson et al. | 430/529 |
| 5,726,254 * | 3/1998 | Wu et al. | 525/375 |

FOREIGN PATENT DOCUMENTS

| | | |
|---|---|---|
| 96/15185 * | 5/1996 | (WO) . |
| 97/08235 * | 3/1997 | (WO) . |

OTHER PUBLICATIONS

Essenfeld, A. and Wu, K.J., "A New Formaldehyde–Free Etch Resistant Melamine Crosslinker", Waterborne, High Solids, and Powder Coatings Symposium Proceedings, Feb. 1997, pp. 246–258.

Wicks, et al, *Organic Coatings: Science and Technology,* vol. 1: Film Formation, Components and Appearance, pp. 83–103, Wiley (1992).

* cited by examiner

*Primary Examiner*—Hoa Van Le
(74) *Attorney, Agent, or Firm*—Andrew J. Anderson

(57) ABSTRACT

The present invention is directed towards a method of forming a base for an imaging element, which includes providing a support, coating a composition which contains active-hydrogen containing polymers and tris (alkoxycarbonylamino)triazine on a side of the support, and drying the coating composition to form a layer. The present invention is also directed towards a method of forming an imaging element which comprises such a base, which includes the additional step of coating and drying an imaging layer on a side of the support. The invention is further directed towards bases and imaging elements comprising a layer on a side of a support comprising active-hydrogen containing polymers cross-linked with a tris (alkoxycarbonylamino)triazine. In accordance with the invention, a tris(alkoxycarbonylamino)triazine crosslinking agent is employed, which unlike traditional melamine resins, does not emit formaldehyde as a by-product of the crosslinking reaction. This freedom from formaldehyde formation provides an improvement in the manufacturing process because it eliminates the health concerns regarding exposure to formaldehyde and, when the imaging element is a photographic element, permits the preparation of crosslinked coatings that do not adversely effect the sensitometric response of the photographic product.

11 Claims, No Drawings

METHOD FOR FORMING A BASE FOR AN IMAGING ELEMENT, AND AN IMAGING ELEMENT COMPRISING SUCH BASE, WITH IMPROVED CROSSLINKING AGENT

CROSS-REFERENCE TO RELATED APPLICATIONS

Reference is made to, and priority is claimed from, U.S. Provisional Patent Application Ser. No. 60/099,533, filed Sep. 9, 1998, entitled "Imaging Element With Improved Crosslinking Agent", the disclosure of which is incorporated by reference herein.

FIELD OF THE INVENTION

This invention relates in general to preparation of imaging elements and bases for imaging elements, and in particular to a method for forming an imaging element comprising a support, one or more imaging layers, and at least one layer coated from a solution containing active hydrogen-containing polymers and a melamine crosslinking agent. The invention is further directed towards bases and imaging elements comprising a layer on a side of a support comprising active-hydrogen containing polymers cross-linked with a tris(alkoxycarbonylamino)triazine.

BACKGROUND OF THE INVENTION

Layers of imaging elements other than the image forming layer are often referred to as auxiliary layers. There are many types of auxiliary layers such as backing layers, subbing layers, antistat layers, overcoat layers, and the like. In most applications these auxiliary layers are crosslinked by addition of a crosslinking agent in order to improve the physical and chemical properties of the dried layer. A typical auxiliary layer application is a backing layer that provides resistance to scratches, abrasions, blocking, and ferrotyping. The latter two refer to the propensity of layers applied onto the support material or imaging element to stick together as a result of adverse humidity, temperature, and pressure conditions which may occur during manufacture and use of the imaging element. Backing layers must provide these and other physical and chemical properties when employed as very thin layers. Typically these layers are less than one micron in thickness. In addition, when backing layers or other auxiliary layers are used on photographic products they must not adversely affect the sensitometric response of the photographic emulsion layer or reduce the transparency of the processed film.

Glassy, hydrophobic polymers are often employed in auxiliary layers for imaging elements because of their desirable chemical and physical properties. These are most often coated from organic solvent-based solutions. Frequently, a hardener or crosslinking agent is added which will react with the functional groups present on the hydrophobic polymer in order to improve physical properties such as abrasion resistance, moisture insensitivity, high temperature blocking resistance, etc. of the dried layer. Alternatively, water-soluble or water-dispersible polymers may be employed with the appropriate crosslinking agent to provide auxiliary layers with the required properties. Because of continuing environmental pressures to reduce or eliminate organic solvent emissions the latter approach has become much preferred.

A variety of crosslinking agents have been described for use in imaging elements, these include; vinyl sulfones, epoxides, aziridines, isocyanates, carbodiimides, amino formaldehyde resins, and others.

Amino formaldehyde resins are the predominant crosslinking agents for thermosetting coatings. The amino resins most commonly used in coatings are derived from the reaction product of melamine, 2,4,6-triamino-1,3,5-triazine and excess formaldehyde (See Wicks, et al, *Organic Coatings, Science and Technology* Vol. 1: Film Formation, Components, and Appearance, pages 83–103, Wiley (1992)). Coatings combining melamine crosslinking agents with functional polymer resins are employed industrially in such demanding applications as automobile topcoats. Amino formaldehyde resins have also found widespread use in imaging applications. The most popular amino formaldehyde resins used as crosslinking agents are methoxyalkylmelamines represented by formula (1):

(1)

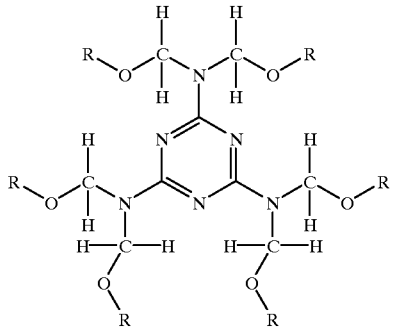

wherein, R represents a $C_1$ to $C_4$ alkyl group.

U.S. Pat. Nos. 5,096,975, 5,198,499, 5,318,878, and 5,576,163 describe antistatic layers for imaging elements crosslinked with methoxyalkylmelamines. The melamine provides process survivability and improved physical properties to the antistat layer.

U.S. Pat. Nos. 4,963,461 and 4,824,756 describe light-sensitive microcapsules comprising a silver halide core and a shell containing a melamine-formaldehyde or urea-formaldehyde resin and light-sensitive materials prepared using the microcapsules.

U.S. Pat. No. 4,123,278 describes a subbing composition for polyester film support consisting of 25–60 weight % of a chlorine-containing copolymer, 15–40 weight % of a butadiene copolymer, and 2–10 weight % of a water soluble melamine-formaldehyde or hydantoin-formaldehyde resin.

A drawback inherent to all of the above is that the amino formaldehyde crosslinking agents employed in the auxiliary layers generate formaldehyde as a by product of the crosslinking process. Exposure of the imaging layer to the formaldehyde that is emitted from the auxiliary layer during the manufacture and storage of the imaging element may adversely effect the sensitometric response of the imaging layer. Additionally, worker exposure to formaldehyde during the manufacture of such imaging elements is undesirable from a heath and safety standpoint.

It is therefore the objective of the present invention to provide a coating composition allowing the preparation of at least one auxiliary layer of an imaging element which retains the positive attributes associated with melamine crosslinking while eliminating the emission of formaldehyde.

SUMMARY OF THE INVENTION

In accordance with one embodiment of the invention, a method of forming a base for an imaging element is described which includes providing a support, coating a composition on a side of the support and drying the coating composition to form a layer, where the coating composition contains active-hydrogen containing polymers and tris (alkoxycarbonylamino)triazine. A method of forming an imaging element is also described which includes providing a support, coating and drying an imaging layer on a side of the support, and coating a composition which contains active-hydrogen containing polymers and tris (alkoxycarbonylamino)triazine composition on a side of the support, and drying the coating composition to form an auxiliary layer. In accordance with further embodiments of the invention, bases for imaging elements comprising a layer on a side of a support comprising active-hydrogen containing polymers cross-linked with a tris(alkoxycarbonylamino) triazine, and imaging elements comprising such bases and an imaging layer, are also described.

In accordance with the invention, a tris (alkoxycarbonylamino)triazine crosslinking agent is employed, which unlike traditional melamine resins, does not emit formaldehyde as a by-product of the crosslinking reaction. This freedom from formaldehyde formation provides an improvement in the manufacturing process because it eliminates the health concerns regarding exposure to formaldehyde and, when the imaging element is a photographic element, permits the preparation of crosslinked coatings that do not adversely effect the sensitometric response of the photographic product.

DESCRIPTION OF THE INVENTION

The imaging element bases and imaging elements to which this invention relates can be any of many different types depending on the particular use for which they are intended. Such elements include, for example, photographic, electrostatographic, photothermographic, migration, electrothermographic, dielectric recording, and thermal dye transfer imaging elements. While the invention is applicable to a variety of imaging elements, the invention is primarily applicable to photographic elements, particularly silver halide photographic elements. Accordingly, for the purpose of describing this invention and for simplicity of expression, photographic elements will be primarily referred to throughout this specification; however, it is to be understood that the invention also applies to other forms of imaging elements.

The imaging elements prepared in accordance with this invention can comprise various polymeric films, papers, glass, and the like, but both acetate and polyester supports well known in the art are preferred. The thickness of the support is not critical. Conventional support thicknesses of from about 50 to 250 microns (2 to 10 mils, or 0.002 to 0.010 inches) can be employed, for example, with very satisfactory results. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer. The auxiliary layers of this invention can be employed as subbing layers, interlayers, overcoat layers, backing layers, receiving layers, barrier layers, timing layers, antihalation layers, antistatic layers, stripping layers, transparent magnetic layers, protective overcoats for antistatic layers, and the like.

The auxiliary layers of the invention are coated from a solution containing active-hydrogen containing polymers and a tris(alkoxycarbonylamino)triazine crosslinking agent. Tris(alkoxycarbonylamino)triazine crosslinking agents that may be effectively employed are represented by formula (2):

(2)

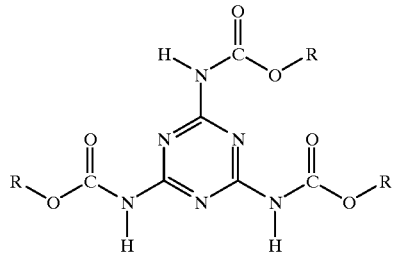

wherein, R represents a $C_1$ to $C_4$ alkyl group. Such crosslinking agents have been described in Essenfeld, A. and Wu, K. J., "A New Formaldehyde-Free Etch Resistant Melamine Crosslinker", Waterborne, High Solids, and Powder Coatings Symposium Proceedings, February 1997, pages 246–258. The tris(alkoxycarbonylamino)triazine crosslinking agent should be used in an amount of from about 0.1 to about 75 percent by weight of the active-hydrogen polymer, preferably from about 0.5 to 40 percent.

Active-hydrogen polymers that are suitable for the purpose of the present invention include those polymers having hydroxyl, carboxylic acid, or epoxy functionality. These polymers may be: (1) natural or synthetic water soluble polymers such as gelatin, polyhydroxyethylcellulose, polyhydroxypropylcellulose, water soluble cellulose acetate, polyvinyl alcohol, (meth)acrylic acid polymers, (meth)acrylamide polymers containing hydroxyl, carboxylic acid, or epoxy functionality, hydroxyalkyl(meth)acrylate polymers, and the like; (2) latex polymers prepared from ethylenically unsaturated monomers containing hydroxyl, carboxylic acid, or epoxy functionality; (3) water dispersible polyurethanes, polyesters and other condensation polymers containing hydroxyl, carboxylic acid, or epoxy functionality; (4) organic solvent soluble polymers such as cellulose esters having hydroxyl or carboxylic acid functionality and polymers prepared from ethylenically unsaturated monomers containing hydroxyl, carboxylic acid, or epoxy functionality, such as (meth)acrylate polymers, styrene polymers, and the like; or (5) organic solvent dispersible polymers such as those described in U.S. Pat. Nos. 5,597,680 and 5,597,681 and having hydroxyl, carboxylic acid, or epoxy functionality. The polymers may be low molecular weight oligomers or high molecular weight polymers. Preferably the molecular weight of the polymer is from about 1000 to $1\times10^7$.

The auxiliary layers of the invention can be applied by any of a number of well-know techniques, such as dip coating, rod coating, blade coating, air knife coating, gravure coating and reverse roll coating, extrusion coating, slide coating, curtain coating, and the like. After coating, the layer is generally dried by simple evaporation, which are preferably accelerated by known techniques such as convection heating. Known coating and drying methods are described in further detail in Research Disclosure No. 308119, Published December 1989, pages 1007 to 1008.

The auxiliary layers of the invention may be applied in any suitable coverage based on the dried weight of the composition and preferably in a coverage of from about 1 $mg/m^2$ to about 10 $g/m^2$.

An acid catalyst such as a mineral acid, an aromatic sulfonic acid, phosphoric acid, alkyl phosphoric acid, etc., may be added to the coating formulation to improve the rate of crosslinking. Preferably the acid catalyst is an aryl sulfonic acid such as p-toluene sulfonic acid. The acid catalyst may be present in an amount of from about 0.1 to about 2 percent of the total weight of the tris (alkoxycarbonylamino)triazine crosslinking agent.

Matte particles well known in the art may also be used in the auxiliary layer compositions of the invention, such matting agents have been described in Research Disclosure No. 308119, published December 1989, pages 1008 to 1009. When polymer matte particles are employed, the polymer may contain reactive functional groups capable of forming covalent bonds with the active-hydrogen containing polymer by intermolecular crosslinking or by reaction with the tris(alkoxycarbonylamino)triazine crosslinking agent in order to promote improved adhesion of the matte particles to the coated layers. Suitable reactive functional groups include: hydroxyl, carboxylic acid, carbodiimide, epoxy, aziridine, vinyl sulfone, sulfinic acid, active methylene, amino, amide, allyl, and the like.

The auxiliary layers of the invention can contain other additives well known in the imaging art such as magnetic recording particles, abrasive particles, conductive polymers, conductive metal oxide particles, coating aids, pigments and dyes, thickeners and other rheology modifiers, charge control surfactants, and lubricants.

In a particularly preferred embodiment, the imaging elements prepared in accordance with the invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

Photographic elements prepared in accordance with the present invention can be simple black-and-white or monochrome elements comprising a support bearing a layer of light-sensitive silver halide emulsion or they can be multilayer and/or multicolor elements. Color photographic elements typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art. A preferred photographic element structure comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, photographic elements prepared in accordance with preferred embodiments of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of photographic elements which may be incorporated in elements prepared in accordance with the invention are contained in, e.g., Research Disclosure, Item 36544, September, 1994.

The light-sensitive silver halide emulsions employed in photographic element imaging layers can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

Photographic silver halide emulsion imaging layers can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are used to illustrate the present invention. However, it should be understood that the invention is not limited to these illustrative examples. The coated bases described in the examples may be coated with one or more imaging layers, such as a photographic silver halide emulsion imaging layer as described in the above cited references, to provide imaging elements in accordance with preferred embodiments of the invention. Alternatively, in addition to silver halide emulsion imaging layers, the imaging layer of imaging elements prepared in accordance with the invention may comprise, e.g., any of the other image forming layers described in Christian et al. U.S. Pat. No. 5,457,013.

EXAMPLES

Example 1

The following example demonstrates the effectiveness of the tris(alkoxycarbonylamino)triazine crosslinker to provide a base for an imaging element having an impermeable protective overcoat layer over an antistat layer. A subbed polyester support was prepared by first applying a subbing terpolymer of acrylonitrile, vinylidene chloride and acrylic acid to both sides of the support surface before drafting and tentering so that the final coating weight was about 90 mg/m$^2$. An antistat formula was coated on one side of the subbed, polyester support to give a total dry coating weight of about 12 mg/m$^2$. The antistat formula consisted of the following components prepared at 0.078% total solids.

| | |
|---|---|
| Eastman Kodak terpolymer*, 30% solids | 0.094% |
| Vanadium pentoxide colloidal dispersion, 0.57% solids | 4.972% |
| Triton X-100 (Rohm and Haas), 10% solids | 0.212% |
| Demineralized water | 94.722% |

*terpolymer as described in subbing coat

The antistat coating was coated with a protective layer containing a binder polymer having hydroxyl groups (cellulose diacetate) to give a dry coating weight after drying at 125° C. equal to 1000 mg/m$^2$. The protective overcoat coating composition consisted of the following components:

| | |
|---|---|
| Cellulose diacetate (CA398-3, Eastman Chemical Company) | 2.50% |
| Tris(alkoxycarbonylamino)triazine crosslinker (Cytec Corp) (monomeric mixture of components having butyl and methyl carbamate groups) | 0.37% |
| Methylene chloride | 77.70% |
| Acetone | 19.43% |

The dried, protective overcoat layer was clear, smooth and provided the antistat layer with a chemical barrier to photographic processing solutions. This antistat material is known to lose electrical properties after photographic processing (see, for example, U.S. Pat. No. 5,006,451) when it is not overcoated with an impermeable protective layer. The internal electrical resistivity (measured using the salt bridge method, described in R. A. Elder, "Resistivity Measurements on Buried Conductive Layers", EOS/ESD Symposium Proceedings, September 1990, pages 251–254.) of the support structure of Example 1 was about $1\times10^8$ ohm/square before and remained unchanged after processing the support in a standard ECP-2 Color Print process.

Example 2

The following example illustrates the use of tris (alkoxycarbonylamino)triazine to crosslink gelatin-containing coatings. A 10% solution of tris (alkoxycarbonylamino)triazine (monomeric mixture of components having butyl and methyl carbamate groups, obtained from Cytec Corp.) in n-propanol was added dropwise to a solution of deionized gelatin at 40° C. while mixing with a high-speed mixer. The resulting solution was coated onto subbed polyester support, prepared as in Example 1, and dried at 125° C. for 3 minutes to yield a layer with a dry coating weight of 1000 mg/m$^2$ at a concentration of tris(alkoxycarbonylamino)triazine equal to 10 wt % based on the weight of gelatin. The resulting layer was highly transparent and was not removed after 50 aggressive wipes with a wet paper towel. By comparison, a gelatin coating which was coated and dried in the same manner but did not contain tris(alkoxycarbonylamino)triazine was completely removed after several wipes with a wet paper towel.

While there has been described what are presently considered to be the preferred embodiments of the invention, various modifications and alterations will be obvious to those skilled in the art. All such modifications and alterations are intended to fall within the scope of the appended claims.

What is claimed is:

1. A photographic imaging element comprising:

a support;

a photographic silver halide emulsion imaging layer on a side of the support; and an auxiliary layer on a side of the support comprising active-hydrogen containing polymers cross-linked with a tris(alkoxycarbonylamino)triazine.

2. The element of claim 1 wherein the tris (alkoxycarbonylamino)triazine is represented by the following formula:

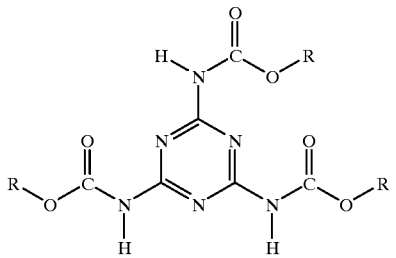

wherein each R represents a $C_1$ to $C_4$ alkyl group.

3. The element of claim 1 wherein the active-hydrogen containing polymer is selected from the group consisting of water soluble polymers containing hydroxyl, carboxylic acid, or epoxy functionality, latex polymers prepared from ethylenically unsaturated monomers containing hydroxyl, carboxylic acid, or epoxy functionality, water dispersible polyurethanes containing hydroxyl, carboxylic acid, or epoxy functionality, polyesters containing hydroxyl, carboxylic acid, or epoxy functionality, organic solvent soluble polymers having hydroxyl or carboxylic acid functionality, polymers prepared from ethylenically unsaturated monomers containing hydroxyl, carboxylic acid, or epoxy functionality and organic solvent dispersible polymers having hydroxyl, carboxylic acid, or epoxy functionality.

4. The element of claim 1 wherein the auxiliary layer comprises a dry coverage of from about 1 mg/M$^2$ to about 10 g/m$^2$.

5. The element of claim 1 wherein the auxiliary layer further comprises an acid catalyst, matte particles, magnetic recording particles, abrasive particles, conductive polymers, conductive metal oxide particles, coating aids, pigments, dyes, thickeners, charge control agents or lubricants.

6. The element of claim 1 wherein the support comprises a polymeric film, paper or glass.

7. The element of claim 1 wherein the auxiliary layer comprises a subbing layer, interlayer, overcoat layer, backing layer, receiving layer, barrier layer, timing layer, antihalation layer, antistatic layer, stripping layer or transparent magnetic recording layer.

8. The element of claim 1 wherein the active-hydrogen containing polymer is selected from the group consisting of water soluble polymers containing hydroxyl, carboxylic acid, or epoxy functionality, latex polymers prepared from ethylenically unsaturated monomers containing hydroxyl, carboxylic acid, or epoxy functionality, water dispersible polyurethanes containing hydroxyl, carboxylic acid, or epoxy functionality, and water dispersible polyesters containing hydroxyl, carboxylic acid, or epoxy functionality.

9. The element of claim 1 wherein the active-hydrogen containing polymer is selected from the group consisting of organic solvent soluble polymers having hydroxyl, carboxylic acid or epoxy functionality, and organic solvent dispersible polymers having hydroxyl, carboxylic acid, or epoxy functionality.

10. The element of claim 1 wherein the active-hydrogen containing polymer has a molecular weight of from about 1000 to $1\times10^7$.

11. The element of claim 1 wherein the tris (alkoxycarbonylamino)triazine is present in an amount of from about 0.1 to about 75 percent by weight of the active-hydrogen polymer.

* * * * *